US005094021A

United States Patent [19]

Chen

[11] Patent Number: 5,094,021

[45] Date of Patent: Mar. 10, 1992

[54] ULTRASONIC IRON

[76] Inventor: Su-Min Chen, No. 9, Yung Kuang Lane, Herming Village, Show Shui Hsiang, Chang Hwa Hsien, Taiwan

[21] Appl. No.: 633,992

[22] Filed: Dec. 26, 1990

[30] Foreign Application Priority Data

Dec. 5, 1990 [TW] Taiwan ..... 79101002

[51] Int. Cl.[5] ..... D06F 75/00; H05B 6/00

[52] U.S. Cl. ..... 38/82; 38/88; 38/90; 219/245; 219/254

[58] Field of Search ..... 38/113, 69, 74, 82, 38/88, 89, 93; 219/245, 254; 112/217

[56] References Cited

U.S. PATENT DOCUMENTS

| | | | |
|---|---|---|---|
| 1,864,010 | 6/1932 | Becket | 38/74 |
| 2,079,708 | 5/1937 | Hart | 38/82 X |
| 2,133,494 | 10/1938 | Waters | 38/82 X |
| 4,347,428 | 8/1982 | Conrad et al. | 38/88 X |
| 4,520,257 | 5/1985 | Schwob et al. | 38/82 X |
| 4,571,483 | 2/1986 | Fathi | 38/69 X |
| 4,686,352 | 8/1987 | Nawrot et al. | 219/250 |
| 4,688,339 | 8/1987 | Tsai | 38/77.7 |
| 4,745,260 | 5/1988 | Albinger et al. | 38/74 X |
| 4,823,713 | 4/1989 | Ogawa et al. | 112/217 |
| 4,928,611 | 5/1990 | Ogawa | 38/1B X |

FOREIGN PATENT DOCUMENTS

| | | | |
|---|---|---|---|
| 0194170 | 10/1985 | Japan | 38/82 |
| 2038200 | 2/1987 | Japan | 38/69 |
| 1310699 | 12/1989 | Japan | 38/82 |

*Primary Examiner*—Werner H. Schroeder
*Assistant Examiner*—Ismael Izaguirre
*Attorney, Agent, or Firm*—McGlew & Tuttle

[57] ABSTRACT

An ultrasonic iron comprises a metal ironing plate fixedly mounted therein, ultrasonic vibrators and amplitude amplifiers, and a power adjusting circuit provided on suitable inner side thereof, so that the power adjusting circuit is capable of driving the ultrasonic vibrator as to resonate the ironing plate with a high frequency as soon as the ultrasonic iron is switched on. Heat energy is thereby quickly and directly produced between the contact surface of the ironing plate and the clothes when the ultrasonic iron is moved on the clothes back and forth. The heat energy required for the pressing of clothes is available immediately upon the onset of operation of the iron.

11 Claims, 3 Drawing Sheets

ULTRASONIC IRON

BACKGROUND OF THE INVENTION

1. Field of the Invention

The present invention relates to an electrical appliance, and more particularly to an ultrasonic iron.

2. Description of Prior Art

A prior art iron has a heating member comprising a flat heating wire winding around a mica flake and sandwiched between two other mica flakes. The prior art iron is defective in design in that heat energy is wasted by virtue of the indirect heat transmission between the heating member and the ironing plate. Another problem is that the iron can not be put to use at the threshold of being put into operation until a waiting period has elapsed to allow the transmission of workable heat from the heating member to the ironing plate to take place.

SUMMARY AND OBJECT OF THE INVENTION

It is therefore an object of the present invention to provide an ultrasonic iron with means to enable the ironing plate to generate heat directly so as to conserve heat energy. Clothes can be ironed as soon as the ultrasonic iron is switched on.

The present invention may best be understood through the following description with reference to the accompanying drawings, in which:

DETAILED DESCRIPTION OF THE PREFERRED EMBODIMENT

Figure 1:
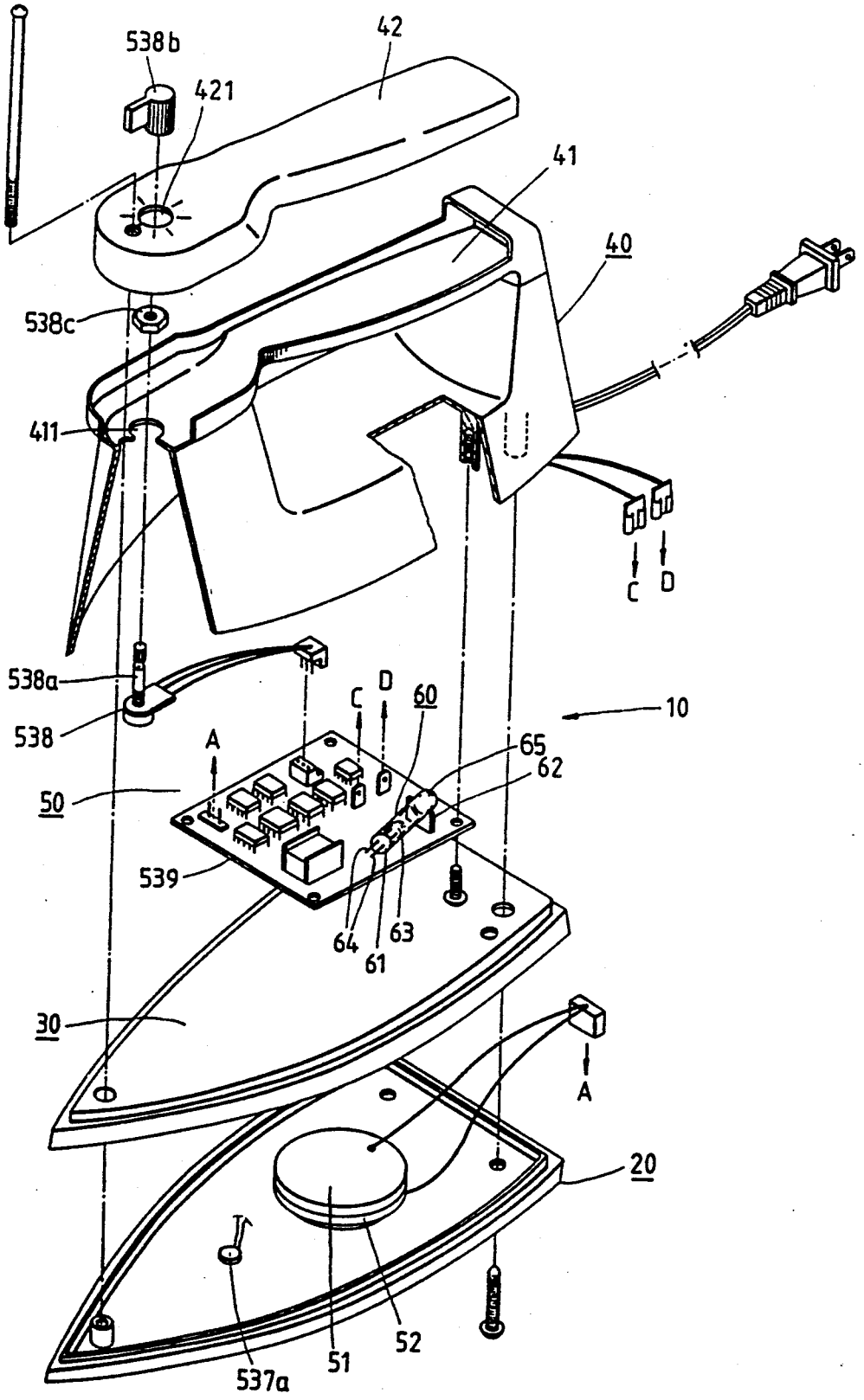
FIG. 1 is an exploded perspective view of an ultrasonic iron according to the present invention.
Figure 2:
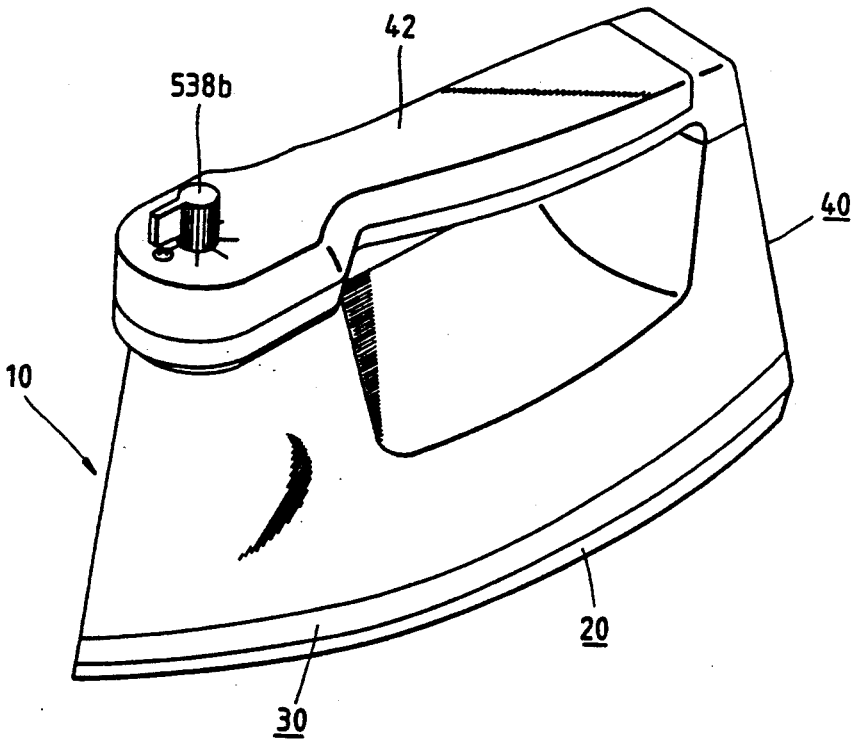
FIG. 2 is an assembled ultrasonic iron from FIG. 1.

Referring now to FIGS. 1 and 2, an ultrasonic iron 10 in accordance with the present invention includes an ironing plate 20, a diaphragm 30, a housing 40, an ultrasonic unit 50, and a detecting device 60.

Ironing plate 20, having a shape approximating a triangle, is made of an aluminum alloy.

Housing 40 comprises therein a downwardly extended receiving room and a recess 41 defined at the top thereof for accommodating a handle 42 having a shape corresponding to that of recess 41. A hole 411 defined at the leading edge of recess 41 is in alignment with a hole 421 defined at the leading edge of handle 42.

Figure 3:
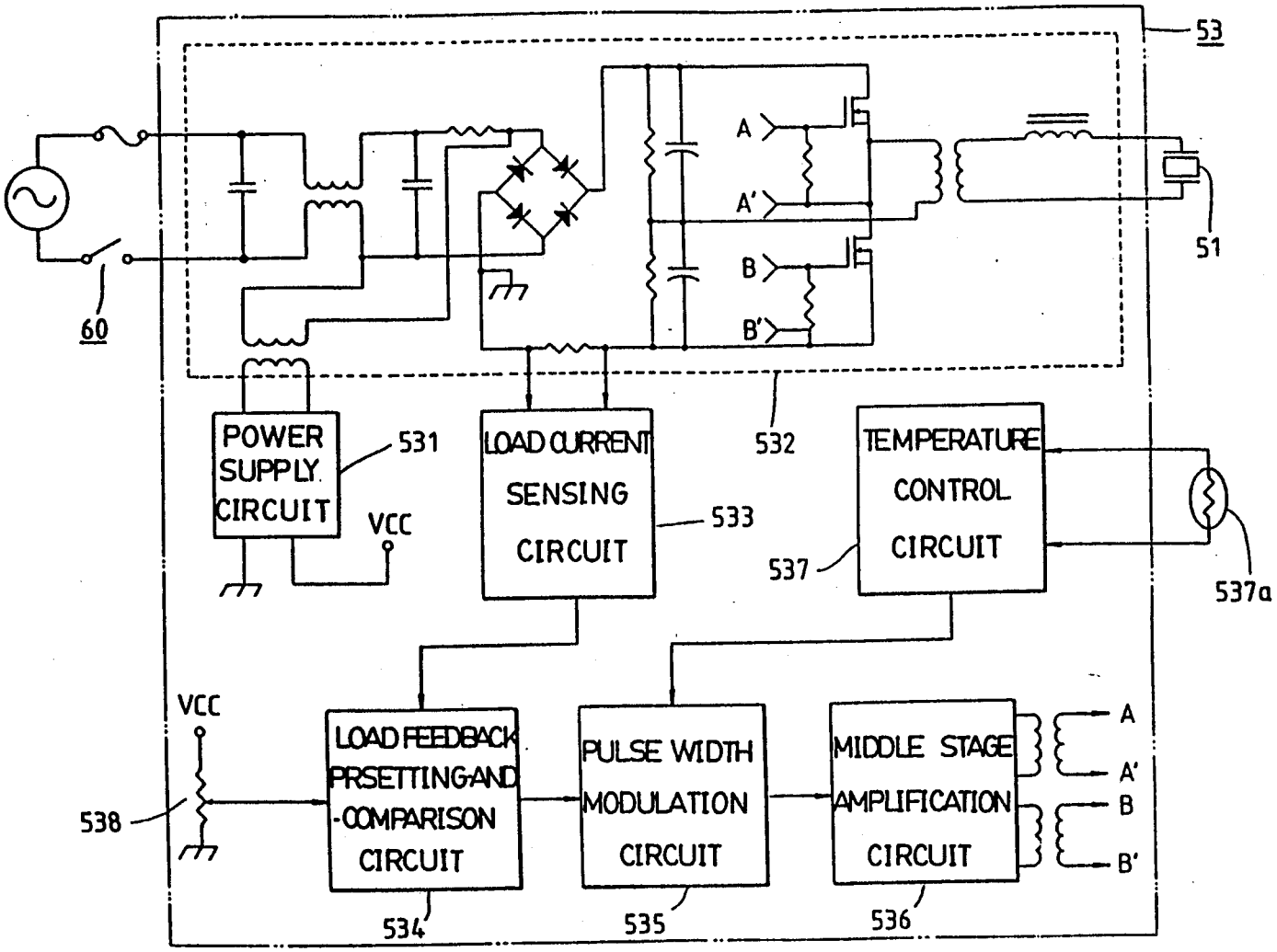
FIG. 3 is a schematic circuit of an ultrasonic iron according to the present invention.

Referring now to FIGS. 1 and 3, ultrasonic unit 50 comprises an ultrasonic vibrator 51, an ultrasonic wave amplifier 52, and a power adjusting circuit 53. Ultrasonic vibrator 51 is fixedly mounted on the ultrasonic wave amplifier 52 which, in turn, is fastened securely to ironing plate 20 by means of epoxy resin adhesive. Power adjusting circuit 53 includes IC components, such as a power supply circuit 531, a high frequency driving main circuit 532, a load current sensing circuit 533, a load feedback presetting-and-comparison circuit 534, a pulse width modulation circuit 535, a middle stage amplification circuit 536, a temperature control circuit 537, and a variable resistor 538. All the above IC components are mounted on a printed circuit board 539 properly positioned in a receiving room of housing 40. Variable resistor 538 contains a revolving axle 538*a* for sequentially passing through hole 411, nut 538*c*, hole 421, wherein, the revolving axle 538*a* is attached to recess 41 of housing 40 by means of a nut 538*c*. Finally, an adjusting knob 538*b* is mounted on top of revolving axle 538*a* for adjusting the resistance of variable resistor 538 when the ultrasonic iron is in use.

A thermal resistor 537*a* fixedly mounted on ironing plate 20 is used as a heat sending means and capable of automatically and temporarily inactivating the temperature control circuit 537 contained in power adjusting circuit 53 when ironing plate 20 is overheated beyond a preset safety range of temperature.

A detecting means can be a mercury switch 60 having a first end 61 fixedly mounted on PC board 539 and an opposite second end 65 fixedly mounted on a stand 62 provided on PC board 539 in such a manner that second end 65 has a higher level than that of first end 61 when ultrasonic iron is put in an operating position, preferably horizontally. Mercury 63 contained in mercury switch 60 can simultaneously contact two bridge ends 64, which are separately disposed at first end 61 and electrically connected to power supply circuit 531, so as to activate mercury switch 60 when ultrasonic iron 10 is held horizontally.

Through the aforementioned combination, mercury switch 60 is first switched on when ultrasonic iron 10 is held horizontally, and subsequently high frequency driving main circuit 532 of power adjusting circuit 53 will drive ultrasonic vibrator 51 to produce an amplitude with a predeterminate frequency. As a result, the amplitude is magnified to an extent that resonance of ironing plate 20 is brought about.

When the bottom of ironing plate 20 is closely urged against and moved back and forth on clothes, a friction force existing between the contact surface of ironing plate 20 and clothes will make ironing plate 20 generate, according to the principle of tribo-heating with high frequency vibration, a workable heat energy. Clothes can be snugly ironed with the foregoing heat energy.

The present ultrasonic iron 10 prevails over a conventional iron in that it can be put to work as soon as it has been switched on.

Furthermore, ultrasonic iron 10 is characterized in that when it is uprightly set up the mercury 63 contained in mercury switch 60 will flow to a second end 65 of mercury switch 60, thereby electrically switching off the two bridge ends 64 provided at the first end 61 of the mercury switch 60 and terminating the action of the power adjusting circuit 53. Therefore, a user of the ultrasonic iron can conserve energy at will by placing the iron at an upright position when not in use.

The amount of heat energy desired for a neat ironing depends on the quality of the clothes. A heat adjusting means allows varing amounts of heat energy to be adjustably generated on ironing plate 20 by rotating the adjusting knob 538*b* of variable resistor 538 to bring about a change in the width of pulse signal of the pulse width modulation circuit 538.

During a given ironing process of the present ultrasonic iron 10, thermal resistor 537*a* will automatically respond momentarily to inactivate temperature control circuit 537 and the vibration of ultrasonic vibrator 51 if ironing plate 20 is overheated beyond a preset safety range of temperature. Ultrasonic vibrator 51 will automatically restore vibration and heat ironing plate 20 in response to an appropriate reduction in temperature of ironing plate 20. Accordingly, any conceivable damage to clothes caused by the heat of ironing plate 20 can be effectively averted.

The main purpose of diaphragm 30 is to separate heat produced by ironing plate 20 from PC board 539, so that the life span of each electrical component fixedly mounted on PC board 539 will not be shorten by the heat.

What is claimed is:

1. An ultrasonic hand iron comprising:

an ironing plate;

ultrasonic means attached to said ironing plate for generating ultrasonic waves in said ironing plate; and a housing attached to said ironing plate having handle means for grasping said housing and moving said housing and said ironing plate with a human hand in order to generate heat in said ironing plate by said moving.

2. An iron in accordance with claim 1, wherein:

said ironing plate is substantially triangular in shape.

3. An iron in accordance with claim 1, further comprising:

an ultrasonic wave amplifier placed between said ultrasonic means and said ironing plate.

4. An iron in accordance with claim 1, further comprising:

detecting means for inhibiting said generation of said ultrasonic waves when said ironing plate is not in an operating position.

5. An iron in accordance with claim 1, further comprising:

heat sensing means for inhibiting said generation of ultrasonic waves when said ironing plate is beyond a preset safety range of temperature.

6. An iron in accordance with claim 1, wherein:

said ultrasonic means has an ultrasonic vibrator driven by a middle stage amplification circuit, said middle stage amplification circuit is controlled by a pulse width modulation circuit.

7. An iron in accordance with claim 6, further comprising:

temperature control means connected to said pulse width modulation circuit for sensing temperature in said ironing plate, said pulse width modulation circuit controlling said middle stage amplification circuit dependent on said temperature control means.

8. An iron in accordance with claim 6, further comprising:

a diaphragm between said ironing plate, and a group of said middle stage amplification circuit with said pulse width modulation circuit.

9. An iron in accordance with claim 6, further comprising:

heat adjusting means connected to said pulse width modulation circuit for presetting an amount of said heat to be generated in said ironing plate.

10. An ultrasonic hand iron comprising:

an ironing plate substantially triangular in shape;

a diaghragm means mounted on said ironing plate for slowing heat transfer from said ironing plate through said diaphragm;

an ultrasonic wave amplifier fastened with epoxy resin adhesive on said ironing plate between said ironing plate and said diaphragm means;

an ultrasonic vibrator attached to said ultrasonic wave amplifier for generating ultrasonic waves in said ironing plate;

a printed circuit board means electrically connected to said ultrasonic vibrator for driving said ultrasonic vibrator, said printed circuit board means mounted on a side of said diaphragm means opposite said ironing plate for insulating said printed circuit from said heat transfer from said ironing plate; and a housing attached to said ironing plate and said diaphragm means and containing said printed circuit board means in between said diaphragm means and said housing, said housing having handle means for grasping, directing and moving said housing and said ironing plate with a human hand in order to generate heat in said ironing plate by said moving.

11. An ultrasonic hand iron comprising:

an ironing plate substantially triangular in shape;

a diaphragm means mounted on said ironing plate for slowing heat transfer from said ironing plate through said diaphragm;

an ultrasonic wave amplifier fastened with epoxy resin adhesive on said ironing plate between said ironing plate and said diaphragm means;

an ultrasonic vibrator attached to said ultrasonic wave amplifier for generating ultrasonic waves in said ironing plate;

a printed circuit board means electrically connected to said ultrasonic vibrator for driving said ultrasonic vibrator, said printed circuit board means mounted on a side of said diaphragm means opposite said ironing plate for insulating said printed circuit from said heat transfer from said ironing plate, said printed circuit board means has a middle stage amplification circuit, said middle stage amplification circuit is controlled by a pulse with modulation circuit, with a load feedback presetting and comparison circuit, a temperature control circuit, a load current sensing circuit, a power adjusting circuit and a power supply circuit; and a housing attached to said ironing plate and said diaphragm means and containing said printed circuit board means in between said diaphragm means and said housing, said housing having handle means for grasping, directing and moving said housing and said ironing plate with a human hand in order to generate heat in said ironing plate by said moving.

* * * * *